US005137187A

United States Patent [19]

Nichols et al.

[11] Patent Number: 5,137,187

[45] Date of Patent: Aug. 11, 1992

[54] ANTI-SPRAY FLUID DISPENSING NOZZLE

[75] Inventors: Peter Nichols, Montreal; Robin Lapointe, Pointe-Claire, both of Canada

[73] Assignee: H.G. Kalish, Pointe-Claire, Canada

[21] Appl. No.: 658,016

[22] Filed: Feb. 20, 1991

[51] Int. Cl.[5] ..... B67D 3/00; B67D 5/06

[52] U.S. Cl. ..... 222/504; 222/453; 222/518; 222/559; 222/571; 239/541; 239/559; 239/583; 141/128; 141/258; 141/392

[58] Field of Search ..... 222/449, 450, 451, 453, 222/495, 496, 504, 518, 380, 559, 571, 476; 239/570, 541, 583, 559; 141/128, 250, 258, 374, 392

[56] References Cited

U.S. PATENT DOCUMENTS

| | | | |
|---|---|---|---|
| 2,168,380 | 8/1939 | Winton | 226/108 |
| 2,366,343 | 1/1945 | Ludwig | 222/453 X |
| 3,128,915 | 4/1964 | Matter | 222/453 X |
| 3,246,808 | 4/1966 | Lidell et al. | 222/504 X |
| 3,385,328 | 5/1968 | Riesenberg | 141/96 |
| 3,559,702 | 2/1971 | Riesenberg | 141/128 |
| 3,580,699 | 5/1971 | Vaughan | 222/453 X |
| 3,707,174 | 12/1972 | Lewis | 141/157 |
| 4,235,265 | 11/1980 | Feliks | 141/85 |
| 4,437,498 | 3/1984 | Pankratz et al. | 141/89 |
| 4,462,436 | 7/1984 | Rangwala | 141/250 |
| 4,537,335 | 8/1985 | Rangwala et al. | 222/496 |
| 4,606,382 | 8/1986 | Biller et al. | 141/1 |
| 4,621,747 | 11/1986 | van der Velde et al. | 222/137 |
| 4,798,337 | 1/1989 | Shimokawa | 239/570 |
| 5,027,983 | 7/1991 | Wakabayashi et al. | 141/258 X |

*Primary Examiner*—Michael S. Huppert
*Assistant Examiner*—Kenneth DeRosa
*Attorney, Agent, or Firm*—Shlesinger, Arkwright & Garvey

[57] ABSTRACT

Anti-spray fluid dispensing nozzle for filling an open top container. The nozzle comprises an elongated fluid supply conduit establishing a fluid path between a source of pressurized fluid and the container to be filled. First and second valves are mounted in the supply conduit disposed in a spaced apart relationship with the first valve positioned upstream the second valve. Each valve includes a movable closure member cooperating with a valve seat to control the flow of fluid through the supply conduit. The closure members of both valves are coupled to a common actuating rod mounted for linear movement within the supply conduit to selectively displace each closure member between a valve closed position and a valve opened position. The closure member of the first valve is capable of sliding movement on the actuating rod, permitting the closure members to engage their respective valve seats while moving toward valve closed positions at different instants in time, thereby reducing the fluid pressure differential across the second valve when the latter closes for preventing a fluid spray to occur.

15 Claims, 4 Drawing Sheets

ANTI-SPRAY FLUID DISPENSING NOZZLE

FIELD OF THE INVENTION

The invention relates to the general field of fluid dispensing equipment, more particularly, to an anti-spray fluid dispensing nozzle in filling open top containers.

BACKGROUND OF THE INVENTION

Container filling on an industrial scale is usually performed by automatic filling machines which are capable to repeatedly dispense with high accuracy a predetermined amount of flowable material into individual containers. Commercially available automatic filling machines normally comprise a conveyor belt advancing open top empty containers in a serial order through a filling station and subsequently through a capping station for sealing the containers. For applications where the containers are processed one by one, the filling station comprises a single fluid dispensing nozzle operating in a timed relationship with the containers feed rate. The nozzle comprises an elongated and vertically disposed fluid supply conduit with a discharge port at its lower end. The fluid feed to the supply conduit is achieved through a lateral inlet port located in proximity to the upper end of the supply conduit. The fluid flow through the supply conduit is controlled by a simple valve mechanism for opening or closing the discharge port. The valve mechanism includes a movable closure member coupled to an elongated actuating rod mounted for linear movement within the supply conduit. A pneumatic piston-cylinder assembly supported on the supply conduit selectively displaces the closure member, by the intermediary of the actuating rod, between valve closed and valve opened positions.

The first step of the container filling cycle consists of lowering the filling nozzle within the container to bring the discharge port in proximity to the container bottom. The valve of the nozzle is opened to initiate the fluid delivery and simultaneously the nozzle is lifted out of the container at a rate corresponding to the rate at which the fluid level in the container rises, in order to prevent the lower end of the nozzle to be submerged in the accumulating fluid mass. When the predetermined amount of fluid has been delivered, the valve of the nozzle is closed, terminating the filling cycle.

It has been observed that during the valve closing at the end of the filling cycle, a spray or splasing of fluid may occur. The reason for such spraying has been traced to a very high fluid velocity which develops through the valve immediately before the fluid tight engagement between the closure member and the valve seat is achieved to completely interrupt the fluid flow. Such fluid spray which may also occur when the valve opens to initiate the fluid delivery is highly undesirable because fluid droplets may be projected outside the container necessitating an extensive cleaning of the filling machine. In addition, the fluid spray may project fluid on the outside surface of the container which renders the container unacceptable for further processing.

OBJECT AND STATEMENT OF THE INVENTION

An object of the present invention is a fluid dispensing nozzle capable to deliver precise amounts of fluid into a container or receptacle without causing fluid splashing or spraying at the completion of the fluid dispensing cycle.

The invention provides an anti-spray fluid dispensing nozzle for filing an open top container, comprising:

a fluid supply conduit establishing a fluid path between a source of pressurized fluid and a container to be filled with the fluid;

first and second flow control valves in the supply conduit disposed in a spaced apart relationship with the first valve positioned upstream the second valve, each valve including a movable closure member and a valve seat, the closure members of the valves being coupled to a common actuating rod mounted for movement within the supply conduit to selectively displace each closure member between a valve closed position in which the closure member is in a fluid tight engagement with its associated valve seat and a valve opened position in which the closure member is in a spaced apart relationship with its associated valve seat, the closure member of the first valve being capable of sliding movement on the actuating rod, permitting the closure members to effect fluid tight engagement with their respective valve seats to interrupt the flow of fluid through the supply conduit at different instants in time, thereby allowing a sequential valve closing action in the direction of fluid flow through the supply conduit; and actuator mechanism in a driving relationship with the actuating rod for moving same in the supply conduit for selectively opening or closing the valves, when the actuator mechanism displaces the actuating rod to effect closure of the valves, the closure member of the first valve achieves fluid tight engagement while the second valve is still in the valve opened position, thereby the fluid pressure differential across the closure member of the second valve is reduced when the latter engages its associated valve seat, thus reducing the possibility of fluid spray through the second valve.

In a preferred embodiment, the actuating rod is provided with a stop member for limiting the relative sliding movement between the first valve closure member and the actuating rod. The stop member fulfills a dual function. Firstly, it determines the time interval between the closure of the first and second valves according to its relative position on the actuating rod. Secondly, it serves to raise the closure member of the first valve from its valve seat for opening the valve.

To achieve a sequential valve closing action with an order of progression in the direction of fluid flow through the supply conduit, the distance between the stop member and the closure member of the second valve is less than the distance between the valve seats of the first and second valves. This arrangement is particularly advantageous because it also permits to achieve a sequential valve opening action with an order of progression in a direction contrary to the fluid flow in the supply conduit. In other words, the first valve opens last, whereby any fluid spray which may occur through the second valve is contained within the supply conduit.

In a most preferred embodiment, the fluid supply conduit is oriented generally vertically and as a result, the closure member of the first valve is continuously urged under the effect of gravity against the stop member, travelling therewith when the actuating rod is moved downwardly in a valve closing stroke, until the closure member engages its valve seat. In a variant, a resilient member, such as a coil spring, is provided above the closure member of the first valve to forcefully bring same toward its vavle seat when gravity alone is unsufficient to achieve this result.

DESCRIPTION OF A PREFERRED EMBODIMENT

Figure 1:
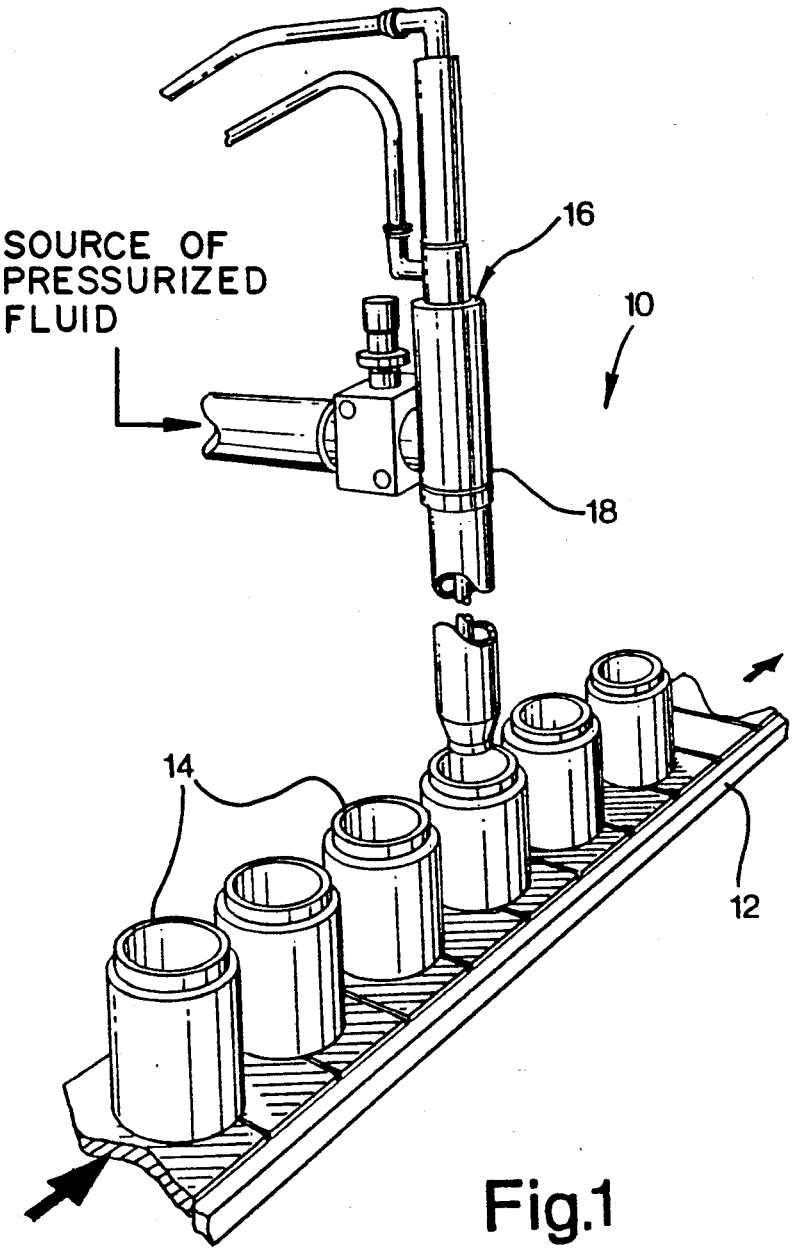
FIG. 1 is a fragmentary perspective view of a container filling apparatus constructed in accordance with the present invention.

Referring now to FIG. 1, the reference numeral 10 designates comprehensively an apparatus for automatically filling with a fluid medium open top containers. The apparatus 10 comprises a conveyor belt 12 which advances the containers 14 in serial order through a filling station 16. The advancement of the containers 14 is made step-wise to bring each container to a stop immediately underneath the filling station 16 which discharges in the container a predetermined quantity of fluid.

The filling station 16 comprises at least one filling nozzle 18 which is inserted in the container for discharging therein the desired amount of fluid. Although not shown in the drawings, the filling nozzle 18 is supported by a mechanism which will lower the nozzle through the container neck to position the nozzle tip in proximity to the bottom of the container at the beginning of the filling cycle. When the discharge of fluid is initiated, the mechanism will progressively retract the nozzle in accordance with the rate at which the fluid level in the container rises. When the predetermined amount of fluid has been delivered, the flow of fluid through the nozzle 18 is shut-off, and the nozzle is raised out of the container, which terminates the filling cycle.

The structure of the filling nozzle 18 will now be described in detail with reference to FIG. 2. The nozzle 18 comprises a nozzle block 20 and a depending vertical channel 22 defining together a fluid supply conduit establishing the fluid path between the source of pressurized fluid to be dispensed (shown in FIG. 1) and the container to be filled. The supply conduit includes a fluid inlet port 24 on the nozzle block and a fluid outlet port 26 at the lower end of the channel 22.

The fluid supply conduit comprises a pair of valves 27 and 28 for controlling the flow of fluid therethrough. Each valve comprises a movable closure member and an associated valve seat which are designated by the same reference numeral as the valve followed by the suffixes "a" and "b", respectively.

The movable closure members **27*a* and 28*a* are coupled to a common actuating rod 30 mounted for linear movement within the fluid supply conduit formed by the nozzle block 20 and the channel 22. A pneumatic piston-cylinder assembly 32 sitting atop the nozzle block 20 is in driving relationship with the actuating rod 30 for vertically displacing same within the nozzle to selectively open or close the valves 27 and 28. The structure of the pneumatic piston-cylinder assembly 32 will not be described in detail because it does not form part of the invention. Suffice it to say that it comprises a movable piston which is directly coupled to the actuating rod 30 and can move under the effect of air pressure built up or under the piston depending upon the desired direction of movement to be imparted to the actuating rod. The lines for supplying the operating fluid to the pneumatic piston-cylinder assembly 32 are identified by the reference numerals 34 and 36**.

The closure member **27*a* is integrally formed at the lower end of the actuating rod 30 and accordingly, it moves in unison with the rod 30. In proximity to the lower edge of the closure member 27*a* is provided a circumferential groove 38 which receives an elastomeric O-ring 40. The O-ring 40 cooperates with the valve seat 27*b* which has a tapered configuration providing a fluid tight seal when the closure member 27*a* is brought in engagement with the valve seat 27*b***.

The closure member **28*a* is similar in construction to the closure member 27*a* in that it comprises a circumferential groove 38 receiving an elastomeric O-ring 40. The major difference between the closure members 28*a* and 27*a* resides in the manner they are coupled to the actuating rod 30. The closure member 28*a* is slidingly mounted on the actuating rod 30 allowing the closure member to move by translation thereon. To permit this sliding motion to occur, a section 46 of the fluid passage of the nozzle block 20 is relieved in order to prevent possible friction interference between the internal wall of this fluid passage and the O-ring 40 of the closure member 28*a*. The relieved section 46 is bordered at the lower end by a tapered zone forming the valve seat 28*b***.

A stop member 44 is provided on the actuating rod 30 below the closure member **28*a* in order to limit in one direction the relative sliding movement between the actuating rod and the closure member. The relative position of the stop member 44 on the actuating rod 30 is important, as it will be discussed later. In the embodiment shown in the drawings, the stop member 44 is positioned so that the distance defined between the closure member 27*a* and the stop member 44 is less than the distance between the valve seats 27*b* and 28*b***.

A sealing member or wiper 47 is secured to the actuating rod 30 above the closure member **28*a*. The function of the sealing element 47 is to prevent fluid from escaping the nozzle block 20 and reaching the actuator mechanism 32. The sealing member 47 is provided with an O-ring 40 which slidingly and sealingly engages the internal wall of the fluid passage within the nozzle block 20**.

The operation of the nozzle 18 will now be described with relation to FIGS. 2 to 6.

Figure 2:
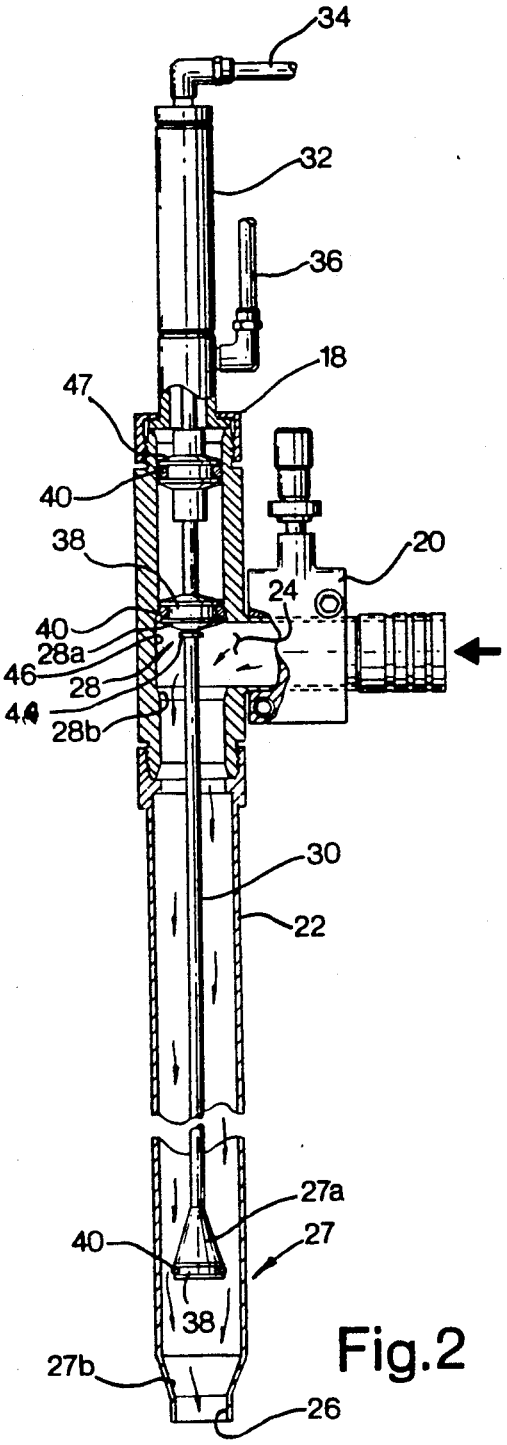
FIGS. 2 to 6 are vertical sectional views of the filling nozzle of the apparatus shown in FIG. 1, illustrating the valve mechanism of the filling nozzle in various positions during a filling cycle.

The nozzle 18 as shown in FIG. 2 is in the fully opened condition. The closure members **27*a* and 28*a* are raised from their respective valve seats, providing a continuous fluid path between inlet and outlet ports 24 and 26** respectively, whereby fluid may freely flow from the source to the container or receptacle to be filled.

Figure 3:
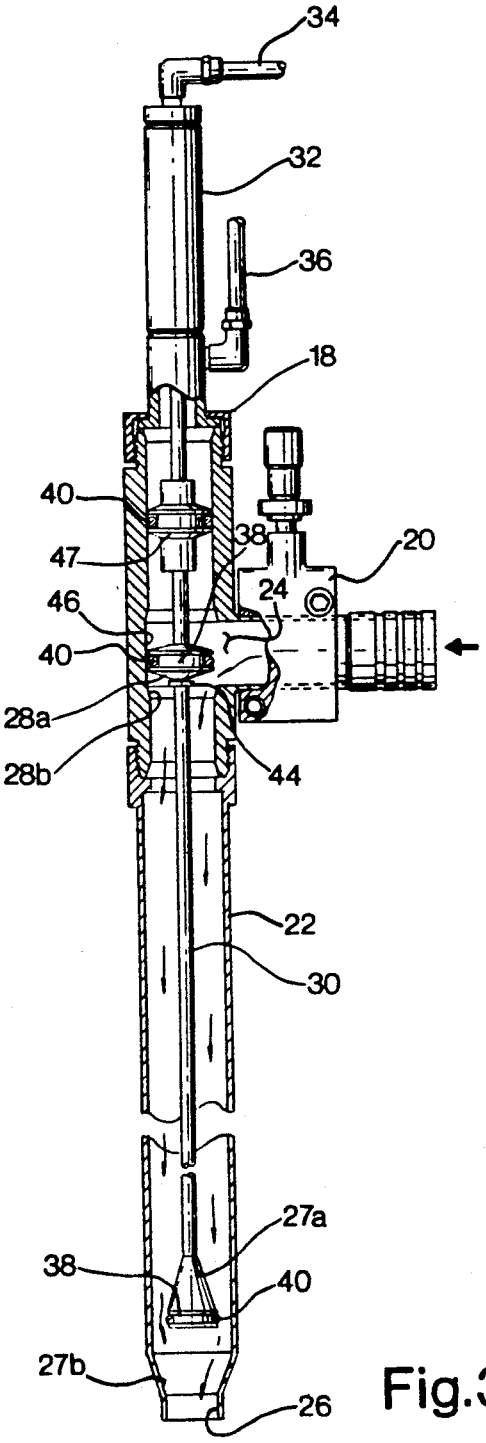

To close the nozzle 18, air under pressure is supplied to the line 34 of the piston-cylinder assembly 32 in order to lower the piston therein and consequently, to impart a descending vertical movement to the actuating rod 30. As shown in FIG. 3, the desceding movement of the actuating rod 30 is followed by the closure member **27*a* and by the closure member 28*a* which under the effect of gravity rests on the stop 44**.

Figure 4:
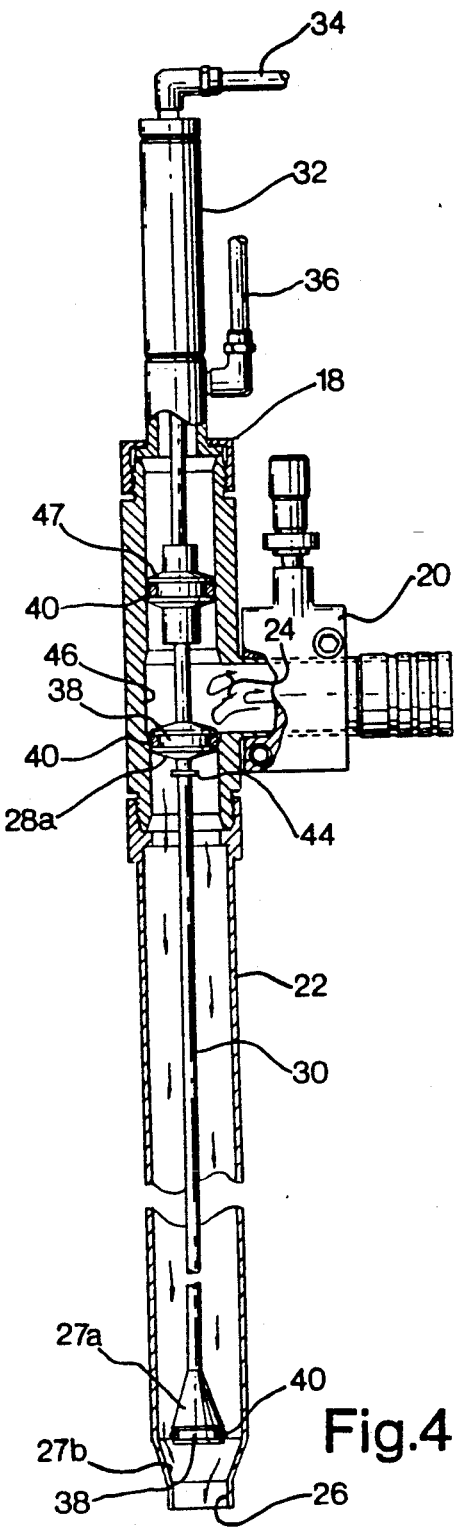

As shown in FIG. 4, the closure member **28*a* will engage the valve seat 28*b*, thus causing valve 28 to close, while the valve 27 is still in the opened condition, because the stop member 44 is positioned at a distance from the closure member 27***a* which is less than the distance separating the valve seats 27*b* and 28*b*. The closure of the valve 28 will interrupt the fluid flow through the nozzle 18. Such fluid interruption will most likely produce a fluid splashing or spraying as a result of the high velocity developed immediately before the valve 28 closes, however the fluid spraying will remain contained within the nozzle since it occurs remotely from the outlet port 26. Since fluid is now no longer flowing through the nozzle 18, the pressure of the fluid mass remaining in the section of the conduit 22 between the valves 27 and 28 is reduced.

Figure 5:
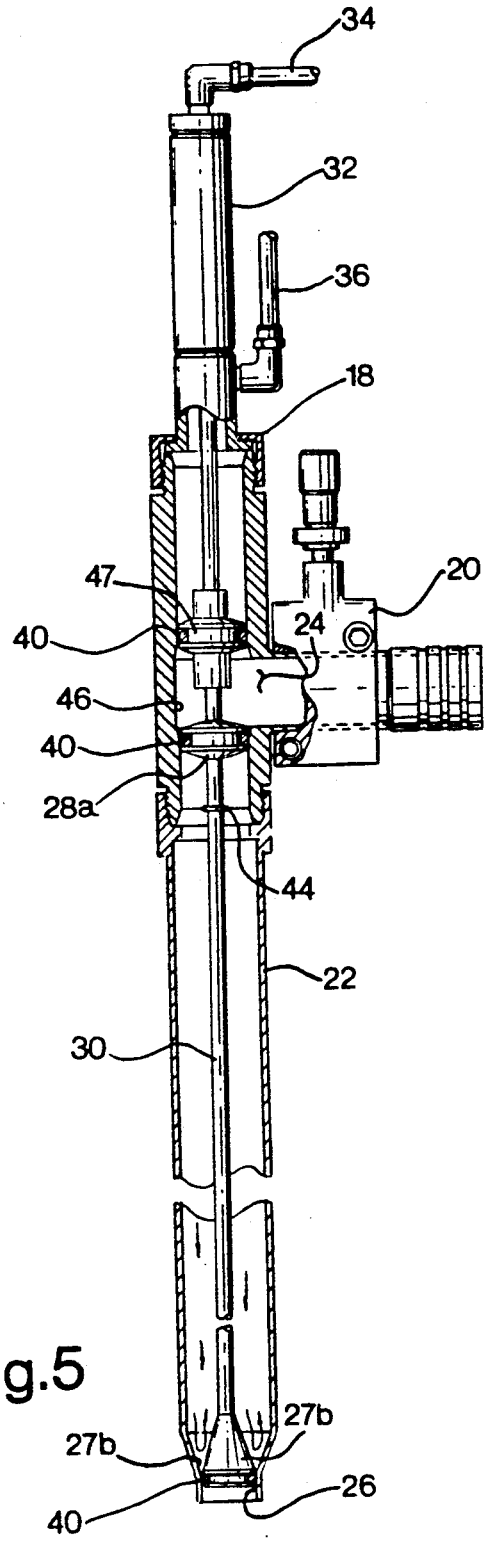

Closure of the valve 27 is possible by virtue of the sliding connection between the closure member 28*a* and the actuating rod 30, which allows the actuating rod to continue descending for bringing the closure member 27*a* in engagement with its valve seat 27*b*, while the closure member 28*a* is maintained in the closed condition, mostly under the effect of fluid pressure acting on the closure member 28*a* and also under the effect of gravity. This sequential closing action in the direction of fluid flow through the nozzle 18 permits to avoid a large pressure differential across the closure member 27*a* when the latter closes, whereby splashing or spraying is unlikely to occur through the outlet port 26. FIG. 5 shows both valves 27 and 28 in the closed condition.

Figure 6:
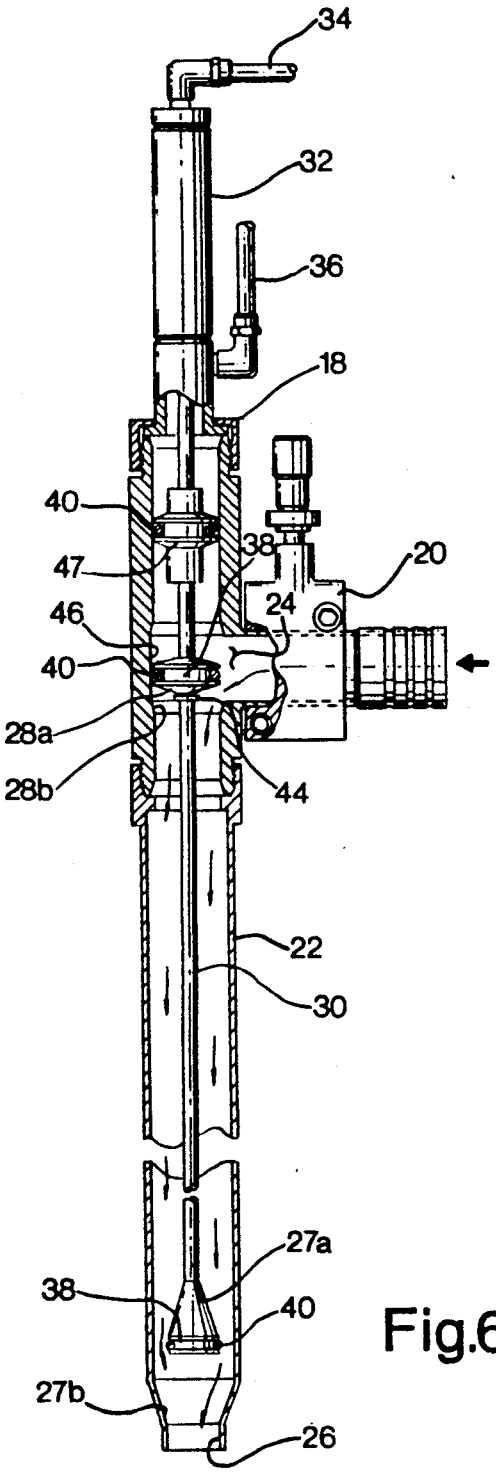

To open the nozzle 18, pressurized fluid is supplied to the actuator mechanism 32 on line 36 to raise the actuating rod 30 which, as best shown in FIGS. 5 and 6, will immediately open the valve 27, while valve 28 is opened after a certain delay. This sequential valve opening action in a direction contrary to the flow of fluid through the nozzle 18 is possible by virtue of the sliding connection between the actuating rod 30 and the closure member 28*a*. The valve 28 will open only when the stop 44 raises the closure member 28*a* off its valve seat thus allowing fluid to flow through the nozzle. Any fluid spraying or splashing which may occur at the opening of valve 28 will remain contained within the nozzle 18 and will not appear at the outlet port 26.

The fluid dispensing nozzle 18 is particularly advantageous because it permits to reduce the possibility of fluid spraying or splashing through the outlet port of the nozzle, while remaining simple in construction. This is particularly advantageous for applications where the fluid must be delivered in a sterile environment and, prior each production run, all the nozzle components must be sterilized. When the nozzle is made of a large number of components, the sterilization process becomes difficult and complex which translates into a higher cost for the container filling operation. The use of a common actuating rod for both valves, and a sliding connection between the actuating rod and the closure member of one valve has proven to be a very desirable and practical alternative to other possible solutions for solving the problem of splashing or spraying of fluid dispensing nozzles.

Figure 7:
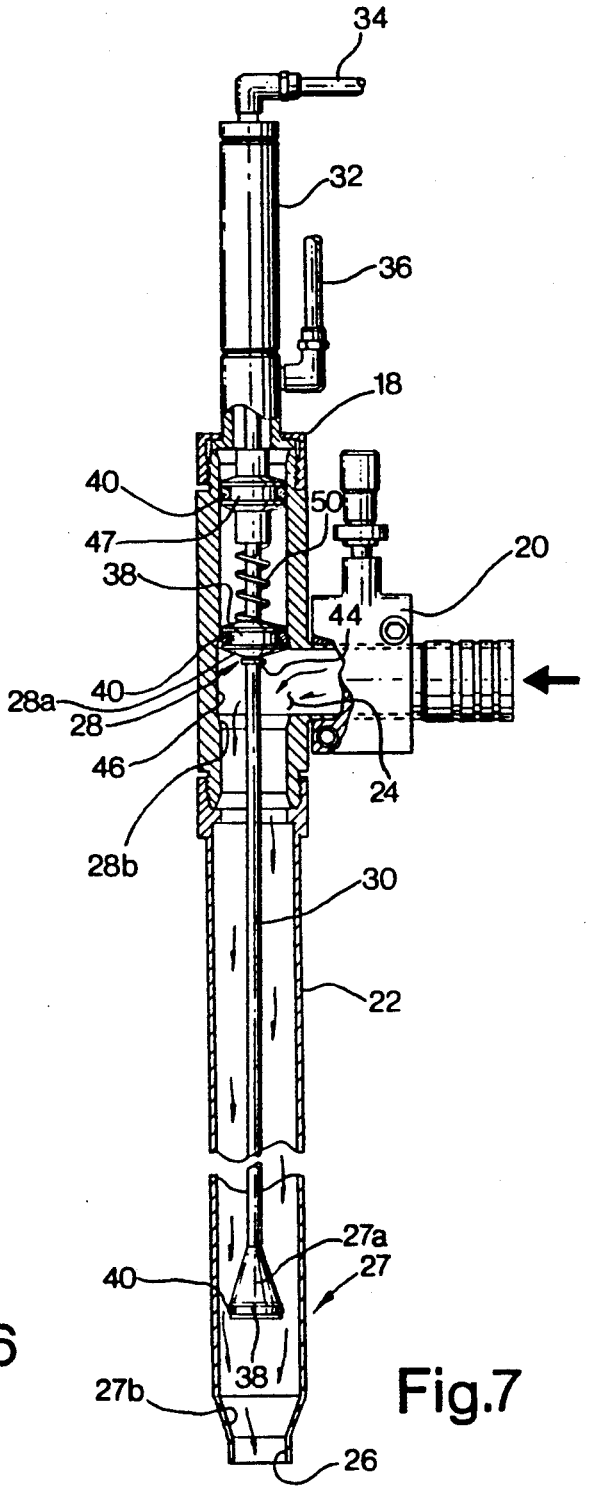
FIG. 7 is a vertical sectional view of a filling nozzle according to a variant.

In a variant, as shown in FIG. 7, a resilient member 50 such as a coil spring is provided above the closure member 28*a* in order to urge downwardly this closure member should gravity alone be insufficient to cause it to follow the actuating rod 30 in its descending movement. The coil spring 50 is held captive on the actuating rod 30 between the closure member 28*a* and the seal 46, the latter acting as an upper abutment driving the spring downwardly during the valve closing stroke of the actuating rod 30. The coil spring 50 is mostly useful for applications where products of high viscosity are being dispensed and where such viscosity may impede the free movement of the closure member 28*a*.

The above description of a preferred embodiment of the invention should not be interpreted in any limiting manner as this embodiment may be refined and varied in many ways without departing from the spirit of the invention. The scope of the invention is defined in the annexed claims.

We claim:

1. Anti-spray fluid dispensing nozzle for filling an open top container, comprising:

a fluid supply conduit establishing a fluid path between a source of pressurized fluid and a container to be filled with the fluid;

first and second flow control valves in said supply conduit disposed in a spaced apart relationship, said first flow control valve being positioned upstream of said second flow control valve, said first and second flow control valves being capable to assume concurrently an opened condition to establish an uninterrupted flow of fluid from said source to said container, and being capable to assume concurrently a closed condition to terminate said flow of fluid, each of said first and second flow control valves including a movable closure member and a valve seat, the closure members of said first and second flow control valves being coupled to a common actuating rod mounted for movement within said supply conduit to selectively displace each closure member between a valve closed position in which the closure member is in a fluid tight engagement with its associated valve seat and a valve opened position in which the closure member is in a spaced apart relationship with its associated valve seat, the closure member of said first valve being capable of sliding movement on said actuating rod, permitting said closure members to achieve fluid tight engagement with their respective valve seats for interrupting the flow of fluid through said supply conduit at different instants in time, thereby allowing a sequential valve closing action with an order of progression in the direction of fluid flow through said supply conduit; and actuator mechanism in a driving relationship with said actuating rod for moving said actuating rod in said supply conduit for selectively opening or closing said first and second flow control valves, when said actuator mechanism displaces said actuating rod to effect closure of said first and second flow control valves, the closure member of said first flow control valve achieves fluid tight engagement with its valve seat while said second flow control valve is still in the opened position, whereby the fluid pressure differential across the closure member of said second flow control valve is reduced when the latter engages its valve seat, thus reducing the possibility of fluid spray through said second flow control valve.

2. Anti-spray fluid dispensing nozzle as defined in claim 1, wherein said actuating rod comprises stop means for limiting the respective sliding movement between the closure member of said first flow control valve and said actuating rod.

3. Anti-spray fluid dispensing nozzle as defined in claim 1, wherein the closure member of said second flow control valve is secured to said actuating rod for moving in unison therewith.

4. Anti-spray fluid dispensing nozzle as defined in claim 3, wherein the closure member of said second flow control valve is secured to an end of said actuating rod.

5. Anti-spray fluid dispensing nozzle as defined in claim 2, wherein said stop means is located on said actuating rod to cause disengagement of the closure member of said first flow control valve from its associated valve seat after the opening of said second flow control valve.

6. Anti-spray fluid dispensing nozzle as defined in claim 2, wherein said actuating rod causes said first flow control valve to open after said second flow control valve.

7. Anti-spray fluid dispensing nozzle as defined in claim 1, wherein said supply conduit comprises a relieved section on an internal wall thereof to allow the closure member of said first flow control valve to move in said supply conduit without interfering with the internal wall of said supply conduit.

8. Anti-spray fluid dispensing nozzle as defined in claim 7, wherein said relieved section is bordered at one end by a tapered portion forming the valve seat of said first flow control valve.

9. Anti-spray fluid dispensing nozzle as defined in claim 7, wherein said supply conduit comprises an inlet port communicating with the source of pressurized fluid, in said relieved section.

10. Anti-spray fluid dispensing nozzle as defined in claim 1, wherein said supply conduit includes an end section which is tapered defining a discharge orifice of the fluid dispensing nozzle, said tapered section also forming the valve seat of said second flow control valve.

11. Anti-spray fluid dispensing nozzle as defined in claim 1, wherein said actuator mechanism is a pneumatic piston-cylinder assembly.

12. Anti-spray fluid dispensing nozzle as defined in claim 2, wherein said stop means is positioned on said actuating rod between said closure members, the distance defined between said stop means and the closure member of said second flow control valve being less than the distance defined between the valve seats of said flow control valves.

13. Anti-spray fluid dispensing nozzle as defined in claim 12, wherein said fluid supply conduit is generally vertically oriented.

14. Anti-spray fluid dispensing nozzle as defined in claim 13, further comprising a resilient member mounted on said actuating rod above the closure member of said first flow control valve for urging said first flow control valves downwardly when said actuating rod is moved to effect closure of said flow control valves.

15. Anti-spray fluid dispensing nozzle as defined in claim 14, wherein said resilient member is a coil spring.

* * * * *